United States Patent [19]

Hermann et al.

[11] 4,302,203

[45] Nov. 24, 1981

[54] PROCESS FOR MODIFYING WOOL TO RENDER IT FLAME RESISTANT

[75] Inventors: Gerson Hermann, Westfield; Babubhai C. Patel, Edison; Emil Baer, Westfield, all of N.J.

[73] Assignee: Apex Chemical Company, Inc., Elizabethport, N.J.

[21] Appl. No.: 96,757

[22] Filed: Nov. 23, 1979

[51] Int. Cl.[3] ..... D06M 3/02; D06P 5/00; D06P 5/02; D06P 3/14

[52] U.S. Cl. ..... 8/490; 8/128 R; 8/495

[58] Field of Search ..... 8/128 R, 17, 490

[56] References Cited

U.S. PATENT DOCUMENTS

| | | | |
|---|---|---|---|
| 2,547,671 | 4/1951 | Sostmann et al. | 106/18.27 |
| 2,986,445 | 5/1961 | Koenig | 8/128 R |
| 3,079,215 | 2/1963 | Koenig | 8/128R |
| 3,097,052 | 7/1963 | Koenig | 8/128 R |
| 3,351,419 | 11/1967 | Fell et al. | 8/17 |
| 3,765,839 | 10/1923 | Mueller et al. | 8/541 |
| 3,927,962 | 12/1975 | Friedman et al. | 8/128 R |
| 3,961,881 | 6/1976 | Sumner et al. | 8/673 |
| 4,007,006 | 2/1977 | Friedman et al. | 8/128 R |

OTHER PUBLICATIONS

Friedman et al., 5th International Wool Textile Research Conference, 9/1975, vol. 5, p. 48.

Friedman et al., Textile Research Journal, vol. 44, 12/74, p. 994.

*Primary Examiner*—Maria Parrish Tungol

*Attorney, Agent, or Firm*—William H. Elliott, Jr.

[57] ABSTRACT

The disclosure relates to a new and improved method of enhancing the fastness of the flame resistance properties imparted to wool by depositing a halophthalic acid derivative on the wool from an aqueous medium and which involves aftertreating such derivative-treated wool product with a fastening agent adapted to fix said derivative on the wool and thereby increase the fastness of the flame resistance properties to wet treatments and dry cleaning.

12 Claims, No Drawings

PROCESS FOR MODIFYING WOOL TO RENDER IT FLAME RESISTANT

This invention relates to a new and improved method of enhancing fastness of the flame resistance properties imparted to wool by depositing a halophthalic acid derivative on the wool from an aqueous medium and which involves aftertreating such derivative treated wool product with a fastening agent adapted to fix said derivative on the wool and thereby increase the fastness of the flame-resistant properties to wet treatments and dry cleaning.

Another aspect of this invention relates to the wool product that results from the aftertreatment carried out in accordance with this invention.

As used herein the term wool, unless the contra is indicated, shall mean 100 percent wool, modified wools (such as chlorinated, resinated wool, shrink resistant wool and the like) and blends thereof with natural and/or synthetic fibers wherein the wool fibers are a substantial component of the textile undergoing treatment.

It is known that the tetrahalophthalic acid derivatives (hereinafter sometimes referred to as the "THA derivative") when deposited on wool in amounts ranging from about 1 to 25 percent (usually in amounts of about 2 to 15 percent) of the weight of the wool being treated will significantly enhance the flame resistance of the wool. It is also known that the "THA derivatives" act in much the same manner as acid wool dyes and can be applied to the wool in the same manner as wool dyes; for example from an aqueous pad bath or they can be exhausted onto the wool from acidic aqueous systems (particularly those having a pH of about 1.5 to 4.5) at elevated temperatures. Other modes of applying the "THA derivative" to wool so as to bring them into intimate contact are known and can be employed for purposes of this invention. However, the flame-resistant properties of the product produced by all heretofore known techniques have inferior fastness to wet treatments and dry cleaning.

It is also known that tetrahalophthalic acid derivatives can be applied to wool from the same bath that is used to dye the wool. One such process is disclosed in U.S. Pat. No. 3,927,962. However, the dyed and flame resistant wool product that is produced by such treatment is also deficient from the standpoint of the fastness of the flame resistance properties to wet treatments and dry cleaning.

It is the objective of the aftertreatment of this invention to increase the fastness to wet treatments and dry cleaning of the flame resistance properties imparted to wool by applying thereto a halophthalic acid derivative.

It is another objective of this invention to provide a product having enhanced flame resistance.

The aftertreatment can be beneficially carried out on undyed wool that has been pretreated with a "THA derivative" or on wool that has been dyed either before or simultaneously with the application of the "THA derivative". Moreover, the invention is not limited to any specific way of applying the tetrahalophthalic acid derivative to wool or impregnating the wool with the "THA derivative". Known conventional techniques (including those of U.S. Pat. No. 3,927,962) can be used for such purpose.

The objectives of this invention are attained in accordance with this invention by aftertreating a wool that is carrying a tetrahalophthalic acid derivative, said aftertreatment involving bringing the so modified wool into intimate contact with an aqueous medium containing a fixative agent capable of binding the "THA derivative" to the wool so that flame-resistant properties imparted thereby exhibit significant improved fastness to wet treatments and dry cleaning.

Fixatives that are especially useful for the purposes of this invention include water-soluble or water-dispersible anionic-phenolic sulfonate formaldehyde condensates, alkaline metal bichromates and colloidal antimony oxide. The phenolic sulfonate formaldehyde condensates are preferred as fixatives because they do not significantly affect the color of the end product and especially suitable are the water-soluble and water-dispersible salts of 1-phenol-2-sulfonic formaldehyde condensates (CAS 61712-58-3).

The aftertreatment can be carried out by any of the conventional techniques and conditions used to apply dye fixatives to textiles from an aqueous media. Preferably, the fixative is applied to the wool by padding in or by exhaustion from an aqueous bath containing the fixative. Regardless of the mode of application, fixative should be applied to the wool under time and temperature conditions that will transfer to and deposit from about 0.1 to 10 percent of the fixative (owf) on the wool textile, and preferably, from the standpoint of effectiveness of treatment and economy, deposit from about 0.3 to 1.2 percent of the fixative (owf) on the wool.

When the fixative is applied by padding, the bath can have a maximum pH of about 7 and preferably a pH of from about 2 to 4.

When the fixative is applied by exhaustion techniques, the bath can have a maximum pH of about 6 and preferably a pH of from about 2 to 4.

As is well known, pressure, time and temperature will influence the rate of application of the fixative to the wool and any combinations thereof adapted to effect the depositing of the requisite quantities of fixative without degrading or otherwise objectionably affecting the end product can be employed.

The aftertreatment of this invention can be used in conjunction with wool products that have been treated with the Flame Inhibiting Composition disclosed in the commonly owned co-pending application, Ser. No. 96,673, now U.S. Pat. No. 4,277,379 filed concurrently herewith by Gerson Hermann, Babubhai C. Patel and Sudhakerbhai B. Patel. The examples of this application will also be found in the aforesaid co-pending application. The disclosures of the specification and claims of said application are expressly incorporated herein by reference.

In this application, the terms "phthalate", "monobasic tetrahalophthalate", etc, have sometimes been used when referring to the halophthalic derivative that is the dispersed phase of the composition. A more precise name for the derivatives being designated by those terms is "the monobasic salt of tetrahalophthalic acid or tetrahalophthalic anhydride".

The following examples will serve to further illustrate the presently preferred method of practicing the invention, and the preparation of materials that are useful therein. In the examples, parts are by weight and temperatures are in Fahrenheit unless otherwise stated.

EXAMPLE 1

(Preparation of the tetrabromophthalate paste)

A stainless steel kettle equipped with good agitation, heating and cooling was charged with 100 lbs. of water, 20 lbs. of polyethylene glycol (M.W. 200), 2½ lbs. of triethanolamine, 42½ lbs. of a non-ionic emulsifying agent (alkoxylated aryl polymer) and 40 lbs. of sorbitol. After mixing was complete, 10 lbs. of an anionic dispersing agent (the sodium salt of a formaldehyde-naphthalane sulfonic acid condensate) was added and the mixture stirred until all these additions were dissolved. With continued stirring, 500 lbs. of tetrabromophthalic anhydride were then added and mixed until uniformily dispersed. 121½ lbs. of 45 percent KOH were then added. The reaction was exothermic. The mix was then heated to about 90°-95° C. and stirring continued at 90°-95° C. until a smooth soft uniform paste was formed. The mix was then cooled to 75° C. and 163½ lbs. of a 2.6 percent Xanthan gum solution was added, the mix stirred until uniform and water added as necessary to make 1000 lbs. of paste. The resultant product was a smooth soft uniform paste of 65-66 percent solids, pH 2-3. A 5 percent aqueous dispersion of this product also had a pH of 2-3. One percent of the paste added to boiling water gave an almost clear solution with a pH of 2-3.

The following examples illustrate a one bath method of dyeing wool with 1:1 premetallized dyes (Example 2) and acid leveling dyes (Example 3) and simultaneously imparting flame resistance by exhausting a monobasic tetrahalophthalic acid on to the wool. In these examples, the dyeing and flame resisting treatment is followed by an aftertreatment to enhance the resistance of the flame retardant to wet treatments and dry cleaning.

EXAMPLE 2

Wool fabric cut selvedge to selvedge weighing 4 lbs. was scoured in a conventional manner in a bath at 120° F. containing (based on fabric weight) 1 percent nonionic surfactant and 1 percent soda ash at 140° F. for 20 minutes and then rinsed and neutralized.

The scoured wool was then transferred to a dyebath, the dyebath was set at 120° F. and a 30:1 liquor to wool ratio. Sulfuric acid was added to bring pH of the bath to 2. When pH was stabilized at 2, the temperature was raised to 160° F. and the following were added:

1.8% (owf) Acid Black 52-C.I. No. 15711
0.3% (owf) Acid Red 194
0.3% (owf) Acid Blue 158A-C.I. No. 15050
10.0% (owf) Glauber's Salt The dyebath was run for 5 minutes; the temperature was raised to 160° F. and then 15 percent (owf) of Phthalate Paste from Example 1 (prediluted-1 part of paste to 10 parts of water) was added.

The bath temperature was raised to the boil and the dyebath was run for 60 minutes. The bath was then cooled to 140° F.; 3 percent (owf) of the 1-phenol-2-sulfonic acid formaldehyde condensate fixative solution of Example 4 was then added and the bath was run for 30 minutes at 140° F. The bath was then dropped and the aftertreated fabric rinsed with cold water and then dried.

EXAMPLE 3

A 100 percent wool fabric weighing 600 grams was scoured in a bath containing 1 percent (owf) nonionic surfactant and 1 percent (owf) soda ash for 20 minutes at 165° F. and then rinsed in cold water and set in a fresh bath at 30:1 (liquor to fabric ratio) and a temperature of 120° F. Sulfuric acid was added to bring the pH of the bath to 2. After the pH was stabilized at 2, then the following were added:

1.33% (owf) Acid Red 1 (C.I. No. 18050)
0.65% (owf) Acid Yellow 17 (C.I. No. 18965)
10.00% (owf) Glauber's Salt and the temperature raised to 160° F. 15 percent (owf) of the Phthalate Paste of Example 1 was then added to the bath, and the bath temperature raised to and held at the boil for 60 minutes. The bath was then cooled to 150° F., and sulfuric acid added as necessary to maintain pH at 2. 3 percent (owf) of the 1-phenol-2-sulfonic formaldehyde condensate fixative solution of Example 4 was then added and the bath run for 30 minutes at 140°-150° F. The bath was then flooded with cold water and dropped. The treated fabric was then rinsed cold and frame dried at 250° F.

EXAMPLE 4

(Preparation of 1-phenol-2-sulfonic formaldehyde condensate fixative solution)

A stainless steel kettle equipped with good agitation, heating, cooling and ventilation was charged with water (36 lbs.), 45 percent KOH (13½ lbs.) and mixed. Phenol (169 lbs.) was melted, added to the kettle with care and mixed until uniform. The charge was heated to 80° C. and 37 percent formaldehyde (146 lbs.) was added while maintaining the temperature at 85°-90° C. The temperature was then raised to and maintained at 90°-95° C. for 45 minutes. Glacial acedic acid (6½ lbs.) was then added to drop the pH to 4. Sodium metabisulfite (67 lbs.) was then added, the mix held at 90°-95° C. for 75 minutes, and then cooled to 50°-55° C. 85 percent phosphoric acid (25 lbs.) was then added. The temperature was raised to 90° C. and held at 90°-95° C. until 2-3 drops of the product gave an opalescent solution in 20 cc of 2 percent aqueous NaCl. When this point was reached, water (144 lbs.) was added and the batch cooled below 75° C. KOH was then added to adjust the pH to 6-6.5 and water was added to adjust the solids content to 32-33 percent. The solution was then cooled below 50° C. The resultant product was a clear dark yellow to amber thin liquid, pH 6-6.5.

EXAMPLE 5

An unscoured wool/nylon blend (70/30) was set in the dyebath with water at 120° F. Sulfuric acid was added as necessary to bring pH to 2. After the pH was stabilized at 2, the temperature of the bath was raised to 160° F. and 20 percent (owf) of the Phthalate Paste of Example 1 (prediluted -1 part paste to 10 parts water) was then added. The temperature of the bath was then raised to the boil, the bath was run for 60 minutes and then cooled to below 175° F. Both the fabric and the bath were then split into 5 equal parts. The fabric in Bath #1 was merely removed, rinsed and dried.

To baths #2-5, 0.3 percent, 0.6 percent, 0.9 percent and 1.2 percent (owf) of the fixative of Example 4 were added and the aftertreatment was carried out for 15 minutes at 175°-185° F. The baths were then cooled, the fabrics removed, rinsed and dried.

The fabrics from Baths #1-5 were scoured in a 20:1 water:fabric ratio bath containing 0.1 percent (on weight solution-"ows") non-ionic detergent and 0.1 percent (ows) sodium carbonate for 5 minutes at 140° F. The fabrics were then rinsed and dried.

The fabrics were tested by the flame retardancy test method NFPA-701, Revised 1976, Flame-Resistant Textiles and Films. The results were as follows:

| | | NFPA 701 | | |
|---|---|---|---|---|
| Bath | % Fixative (owf) | Char length (inches) | After-flame (sec.) | After-glow (sec.) |
| #1 | 0 | Burned entire length (BEL) | | |
| #2 | 0.3 | 3 | 4½ | 0 |
| | | 2¾ | 2 | 0 |
| #3 | 0.6 | 2½ | 1½ | 0 |
| | | 2¼ | 2 | 0 |
| #4 | 0.9 | 2¼ | 1 | 0 |
| | | 2 | 1 | 0 |
| #5 | 1.2 | 2½ | 3 | 0 |
| | | 3 | 3 | 0 |

EXAMPLE 6

A nylon/wool (70/30) blend was pretreated with phthalate paste and the bath was cooled as described in Example 5. The fabrics were then removed, rinsed and dried.

Portions of the pretreated fabric were then subjected to aftertreatment with various fixatives and one portion (the control) was not aftertreated.

The aftertreatments were carried in separate baths containing water and:

Fabric #1 6% (owf) sodium bichromate

Fabric #2 1.5% (owf) colloidal antimony oxide

Fabric #3 0.6% (owf) Condensate of Example 4.

In each case 4 percent (owf) 66° Be sulfuric acid was present in the aftertreating bath to adjust pH to about 2. The temperature was raised to 185° F. and held for 15 minutes. The baths were cooled, the fabrics were removed, rinsed, scoured, dried and tested as in Example 5. A portion of the control fabric was also scoured as described in Example 5. The results are tabulated in Table 2.

TABLE 2

| | | NFPA - 701 | | | |
|---|---|---|---|---|---|
| Fabric | Fixative | % Fixative (owf) | Char Length (inches) | After-flame (sec.) | After-glow (sec.) |
| Control (unscoured) | none | none | 2½ | 0 | 0 |
| | | | 3 | 0 | 0 |
| Control (scoured) | none | none | Burned entire length (BEL) | | |
| #1 | Bichromate | 6 | 2¼ | 1½ | 0 |
| | | | 2¾ | 3 | 0 |
| #2 | Antimony Oxide | 1.5 | 3¼ | 2½ | 0 |

TABLE 2-continued

| | | NFPA - 701 | | | |
|---|---|---|---|---|---|
| Fabric | Fixative | % Fixative (owf) | Char Length (inches) | After-flame (sec.) | After-glow (sec.) |
| | | | 3¾ | 4 | 0 |
| #3 | Example 4 Condensate | 0.6 | 2¾ | 2 | 0 |
| | | | 2¾ | 2 | 0 |

We claim:

1. A process for enhancing the flame resistance of wool carrying a tetrahalophthalic acid in or on the fiber which comprises after treating the so-modified wool by contacting it with an aqueous medium containing, as a fixative capable of fastening the phthalic acid compound to the wool, a water soluble or water dispersible anionic phenolic sulfonate formaldehyde condensate, an alkali metal bichromate, or colloidal antimony oxide.

2. The process of claim 1, wherein the fixative is a salt of 1-phenol-2 sulfonic formaldehyde condensate.

3. The process of claim 2 wherein the condensate is applied to the wool from an aqueous medium so as to deposit thereon from about 0.1 to 10 percent condensate based on weight of the wool textile being treated.

4. A process according to claim 3 wherein the condensate deposited thereon is from 0.3 to 1.2 percent condensate based on weight of wool textile being treated.

5. A process according to claim 3 wherein the fixative is applied to the wool by padding the wool with a bath at a maximum pH of about 7.

6. A process according to claim 3 wherein the fixative is exhausted onto the wool from an acidic aqueous bath at a maximum pH of about 6.

7. The process of claim 1 wherein the halophthalic acid derivative is tetrachlorophthalic acid or tetrabromophthalic acid.

8. The process of claim 1 wherein undyed wool is subjected to the aftertreatment.

9. The process of claim 1 wherein the wool subjected to the aftertreatment was dyed prior to the application of the halophthalic acid derivative thereto.

10. The process of claim 1 wherein the halophthalic acid derivative and a wool dye are applied to the wool from the same bath before the aftertreatment.

11. In a process for simultaneously dyeing and enhancing the flame resistance of wool by exhausting tetrachlorophthalic acid or tetrabromophthalic acid thereon from an acidic dyebath having a pH of from 1.5 to 4.5, the improvement which comprises on completion of the dyeing, cooling the bath to below about 180° F.; readjusting the pH as necessary to provide a maximum pH of about 6; adding a salt of 1-phenol-2-sulfonic formaldehyde condensate to the bath, and maintaining the dyed wool in contact therewith under time and temperature conditions to deposit thereon from 0.1 to 10 percent by weight of the condensate on the wool.

12. The aftertreated wool produced in accordance with any one of claims 1 to 12.

* * * * *